United States Patent [19]

Hirata

[11] 4,235,433

[45] Nov. 25, 1980

[54] PAPER SHEET STORAGE BOX FOR PAPER SHEET DISPENSER

[75] Inventor: Akira Hirata, Tokyo, Japan

[73] Assignee: Laurel Bank Machine Co., Ltd., Tokyo, Japan

[21] Appl. No.: 16,490

[22] Filed: Mar. 1, 1979

[30] Foreign Application Priority Data

Mar. 3, 1978 [JP] Japan ..... 53/27362[U]

[51] Int. Cl.[3] ..... B65H 1/02

[52] U.S. Cl. ..... 271/162; 221/197

[58] Field of Search ..... 221/197, 198; 271/162, 271/163, 164, 30 A, 129; 49/395

[56] References Cited

U.S. PATENT DOCUMENTS

| | | | |
|---|---|---|---|
| 899,589 | 9/1908 | Churchill | 49/365 |
| 4,008,827 | 2/1977 | Appelbaum et al. | 221/197 |
| 4,113,140 | 9/1978 | Graef et al. | 221/227 X |

*Primary Examiner*—F. J. Bartuska

*Attorney, Agent, or Firm*—Fleit & Jacobson

[57] ABSTRACT

A paper sheet storage box adapted to be removably set in a paper sheet dispenser such as an automatic cash vending machine or a money changing machine. The paper sheet storage box includes a front cover hinged to its leading side and a pair of cam forming lands and a pair of rollers for opening the front cover, when the storage box is inserted into the dispenser for the purpose of being set therein, and for closing the front cover when the storage box is removed from the dispenser. The storage box further includes a retaining pawl and a retaining mechanism for retaining the front cover in a locked condition when the latter is closed. Further inclusive in the storage box is a retaining pin mounted on one side wall of the storage box and an auxiliary engagement member having elasticity. This auxiliary engagement member is carried on the inner side of the front cover at such a position as to be snugly snapped on the retaining pin when the front cover is closed by the coaction of the retaining pawl and the retaining mechanism.

5 Claims, 4 Drawing Figures

PAPER SHEET STORAGE BOX FOR PAPER SHEET DISPENSER

BACKGROUND OF THE INVENTION

1. Field of the Invention

The present invention relates to a paper sheet dispenser such as an automatic cash vending machine or a cash changing machine, and more particularly to a paper sheet storage box for use with the paper sheet dispenser.

2. Description of the Prior Art

Over the past ten years, an increasing number of paper sheet dispensers such as automatic cash vending machines or money changing machines have been installed at banks etc. Such paper sheet dispensers are made responsive to the command of a customer to dispense or release one by one a required number of sheets of paper currency from a storage box which is removably inserted into the body of the paper sheet dispenser. The paper currency thus released is discharged to a preset place or to the outlet of the dispenser. This dispenser is generally placed in front of the counter of a bank or outside of the bank and connected in an on-line manner with a control center. Therefore, the paper sheet storage box is charged in advance with a preset stock of paper currency to be vended and then is carried to and set in the paper sheet dispenser. On the other hand, in order to prevent the paper current from being stolen or taken out from the storage box without permission while this box is being transported, it is necessary that the box act as a kind of safe. For this purpose, the paper sheet storage box has its front cover automatically locked to close its outlet for the paper currency when it is taken out of the body of the paper sheet dispenser, and the front cover is opened only when the storage box is set in the dispenser.

In order to open and close the front cover, however, this kind of the paper sheet storage box conventionally has its front cover opening and closing rollers moved along the cam forming lands which are formed on the side walls inside of the body of the paper sheet dispenser. As a result, when the storage box is pulled out of the dispenser body to close the front cover, the opening and closing rollers are spaced to some extent from the cam grooves so that the front cover fails to be reliably locked in close contact with the body of the storage box, thus leaving a clearance corresponding to that spacing. As a result, in the conventional storage box, the retaining member of the locking mechanism may fail to be smoothly retained by the retaining pawl which operates to lock the front cover and there may remain an amount of play corresponding to the clearance of the front cover.

SUMMARY OF THE INVENTION

It is therefore an object of the present invention to provide a paper sheet storage box for use with a paper sheet dispenser which is free from such drawbacks of the prior art.

According to a major feature of the present invention, there is provided a paper sheet storage box adapted to be removably set in a paper sheet dispenser, comprising: a front cover hinged to the leading side of said storage box; opening and closing means for opening said front cover, when said storage box is inserted into said dispenser for the purpose of being set therein, and for closing said front cover when said storage box is removed from said dispenser: primary retaining means for retaining said front cover in a locked condition when the latter is closed by said opening and closing means; and auxiliary retaining means for ensuring the retaining action of said primary retaining means, said auxiliary retaining means including a retaining pin mounted on one side wall of said storage box, and an auxiliary engagement member having elasticity and carried on the inner side of said front cover at such a position as to be snugly snapped on said retaining pin when said front cover is closed by said opening and closing means.

BRIEF DESCRIPTION OF THE DRAWINGS

Other objects and advantages of the present invention will become apparent from the following description taken in conjunction with the accompanying drawings, in which.

DESCRIPTION OF THE PREFERRED EMBODIMENT

Figure 1:
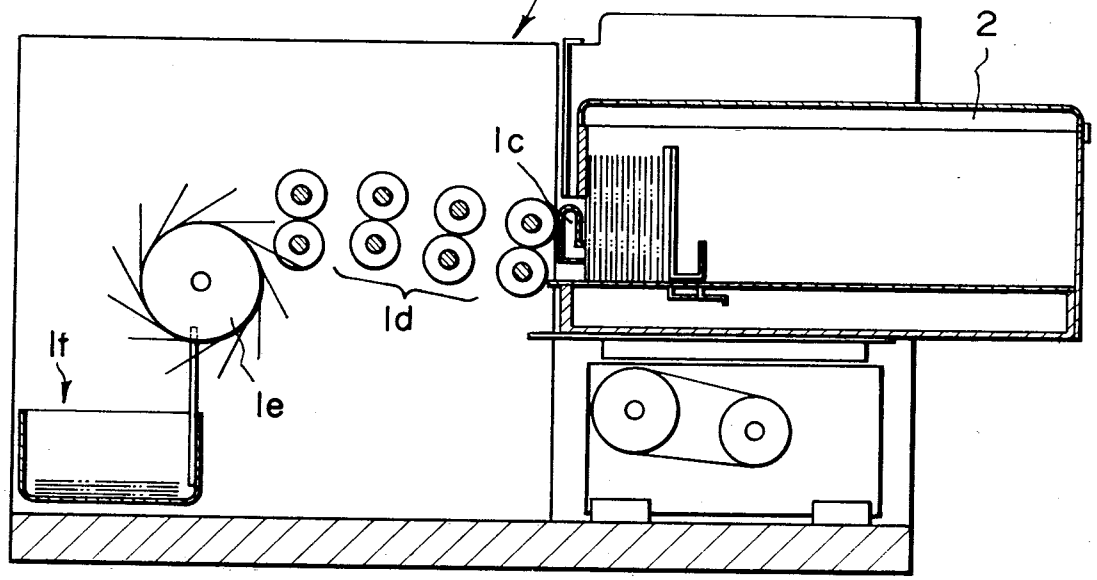
FIG. 1 is a diagrammatic sectional view showing the structural arrangement of a paper sheet dispenser with which a paper sheet storage box according to the present invention is to be used.

The present invention will now be described in detail in connection with a preferred embodiment thereof will reference to the accompanying drawings. Indicated by reference numeral 1 in the drawings is a paper sheet dispenser which is made operative to suck and release paper currency sheet by sheet from a paper sheet storage box 2, in which the paper sheets are stored, by means of a suction tube 1*c* thereof. The sheets of paper currency thus let out are then conveyed by a conveyor belt 1*d* to a dispensing wheel 1*e*. Thereafter, the sheets of paper currency are piled one on another by the action of the dispensing wheel 1*e* within a temporary piling box 1*f* so that they can be prepared to be vended all at the same time via a vending outlet. Moreover, the paper sheet dispenser 1 is formed with a receptacle, in which the storage box 2 is received. The receptacle of the dispenser 1 is formed on each of its side walls with a pair of can forming lands 1*a* and 1*b* which are used to open and close the front cover 3 of the storage box 2. This front cover 3 is mounted rotatably on a pivot 4 and is located at the front side of the storage box 2, which leads or faces forward when the box 1 is inserted into the paper sheet dispenser 1. There are rotatably mounted to an upper portion of the front cover 3 at each side thereof one of a pair of rollers 5 which are moved while rolling on the cam surfaces of the lands 1*a* and 1*b*. Moreover, there is carried on a lower portion of the front cover 3 at the inner side thereof a retaining pawl 6 which is so constructed as to be retained by a main retaining member 7*c* of a retaining mechanism 7, which is mounted in the storage box 2. There is also carried on the inner side of the front cover 3 an auxiliary engagement member 8 which, being a leaf spring having a generally U-shaped cross-section, can be elastically warped. The leaf spring member 8 is constructed to have its one end fixed to the front cover 3 and its other or free end bent slightly to form an angle. Moreover, there is mounted on one side wall of the storage box 2 a retaining pin 9 which is made to project at a right angle from the side wall so as to retain the auxiliary engagement member 8. The retaining pin 9 is preferably be made as a roller so that the engagement member 8 can smoothly engage therewith.

Figure 2:
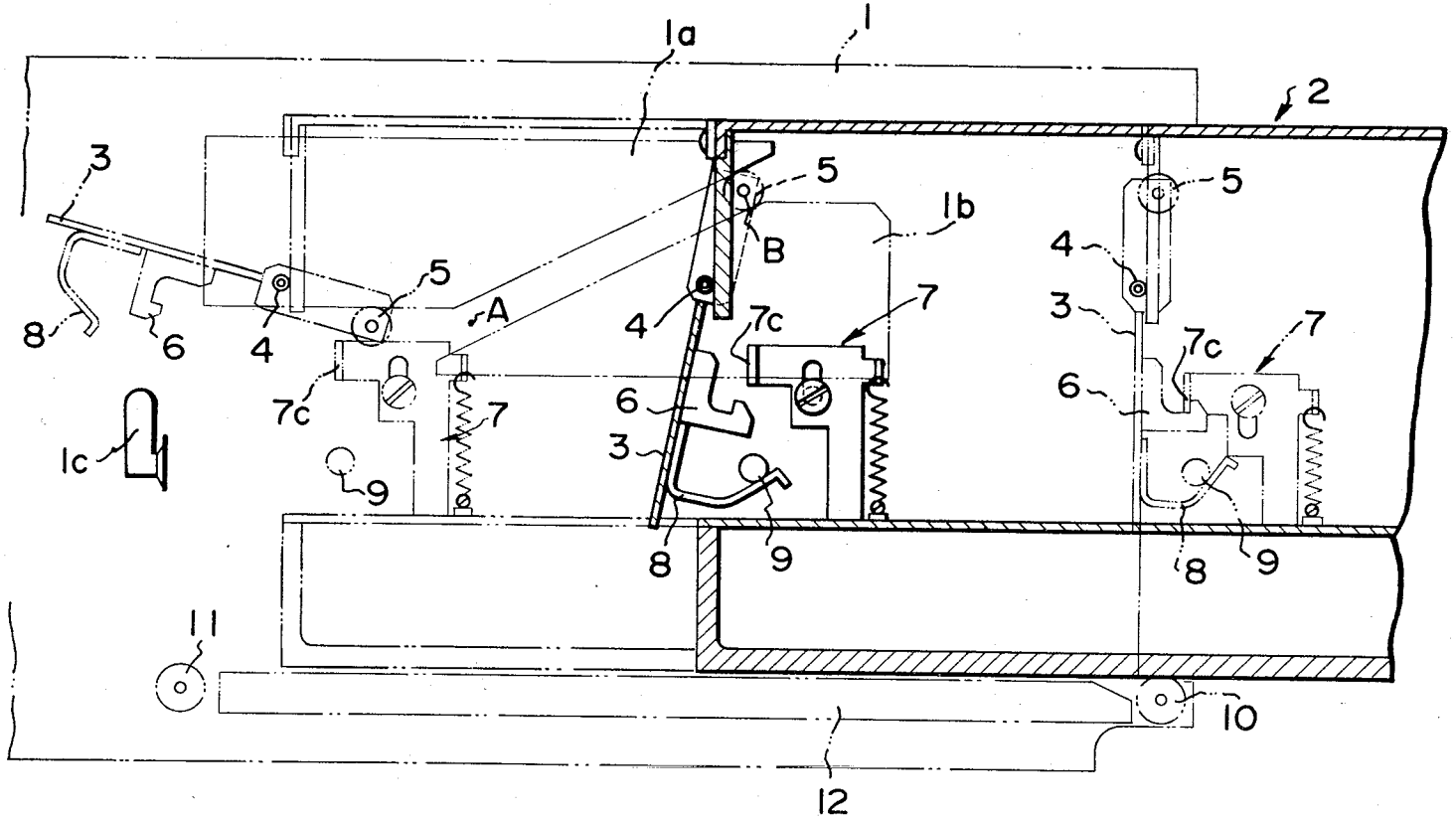
FIG. 2 is a longitudinal section showing in an enlarged scale the paper sheet storage box with its front cover opened and closed.

Indicated by reference numerals 10 and 11 in FIG. 2 are a pair of guide rollers which are used to ensure the smooth movement of the storage box 2 when the latter is to be set in the body of the paper sheet dispenser 1. Indicated by reference numeral 12 in the same Figure, moreover, is one of a pair of guide rails which extend longitudinally on opposite inner sides of the frame of the dispenser 1 in a facing relationship so as to support and guide the storage box 2 until the latter reaches the rollers 11.

Figure 3:
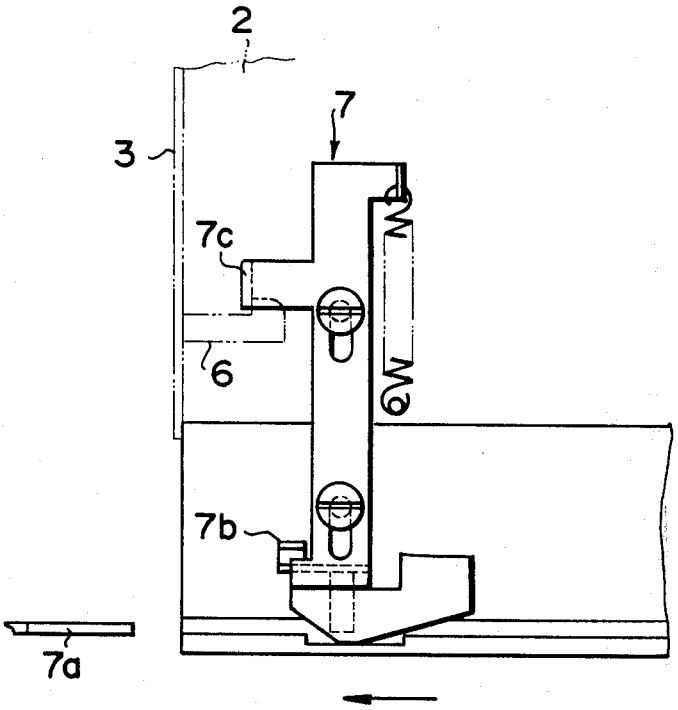
FIG. 3 is a side elevation showing in a further enlarged scale a retaining mechanism to be used in the paper sheet storage box of the present invention.
Figure 4:
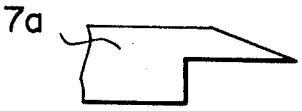
FIG. 4 is an enlarged top plan view showing an actuating member for actuating the retaining mechanism of FIG. 3.

A description will now be made of the insertion and removal of the so constructed paper sheet storage box 2 into and from the body of the paper sheet dispenser 1. First, if the storage box 2 is placed on the guide rails 12 of the dispenser 1 and inserted into the receptacle thereof, as best seen in FIG. 3, the retaining mechanism 7 mounted in the storage box 2 has its preliminary retaining member **7*b* released by the action of its actuating member 7*a* which is fixed on the body of the dispenser 1. As a result, the main retaining member 7*c* is raised, as better seen from the solid lines in FIG. 2, so that it is released from the locked condition by the retaining pawl 6 which is carried on the front cover 3. Then, as the storage box 2 is pushed further inward, the rollers 5 of the front cover 3 are guided and moved gradually downward by the cam surfaces of the lands 1*a* and 1*b* of the dispenser 1 so that the front cover 3 itself is turned clockwise, as viewed in FIG. 2, about the pivot 4. At this time, the auxiliary engagement member 8 of the front cover 3 is elastically straightened by the rotating force of the front cover 3 until it is released from its engagement with the retaining pin 9 of the storage box 2. When the storage box 2 is further pushed to the limit of its inward movement, the front cover 3 is opened into its fully open position of about 90 degrees. Thus, the storage box 2 is set in the body of the paper sheet dispenser 1**.

Next, the removal of the storage box 2 from the paper sheet dispenser 1 will be explained. First, when the storage box 2 is pulled outwardly, the front cover 3 is moved in its open condition until its rollers 5 reach the A point of the cam forming lands **1*a* and 1*b*, as best seen in FIG. 2. When the storage box 2 is further drawn until the rollers 5 of its front cover 3 reach the B point, as indicated by the solid lines in the same Figure, the front cover 3 is turned so that it is gradually closed. More specifically, immediately before the rollers 5 reach the B point, the angularly bent free end portion of the auxiliary engagement member 8 is brought into abuting engagement with the retaining pin 9 and then is elastically straightened to slide on the lower circumference of the retaining pin 9. At the instant when the rollers 5 reach the B point, the auxiliary engagement member 8 is snugly snapped on the retaining pin 9 at its curved portion. Finally, in this condition, as the storage box 2 is pulled out of the body of the dispenser 1, the engagement member 8 is retained on the retaining pin 9 until the front cover 3 is snugly closed by the elastic force of the engagement member 8. Moreover, when snug closure is attained, the retaining pawl 6 is retained on the main retaining member 7*c* of the retaining mechanism 7 so that the storage box 2** is securely locked without fail.

As has been described in detail hereinbefore, there are provided according to the present invention both an auxiliary engagement member which is carried on the inner side of the front cover of the storage box and which is made elastically engageable and a retaining pin which is mounted on one side of the storage box so as to retain the auxiliary engagement member. As a result, when the storage box is pushed into and pulled out of the body of the paper sheet dispenser, especially when the storage box is extracted to have its front cover locked, the front cover can be brought into its locked condition without fail while it is in close contact with the body of the storage box so that the retaining pawl of the front cover can be smoothly and easily retained on the retaining member of the retaining mechanism.

What is claimed is:

1. A paper sheet storage box adapted to be removably set in a paper sheet dispenser, comprising:

a front cover hinged to the leading side of said storage box;

opening and closing means for opening said front cover, when said storage box is inserted into said dispenser to be set therein, and for closing said front cover when said storage box is removed from said dispenser;

primary retaining means for retaining said front cover in a locked condition when the latter is closed by said opening and closing means; and auxiliary retaining means for ensuring the retaining action of said primary retaining means, said auxiliary retaining means including a retaining pin mounted on one side wall of said storage box, and an auxiliary engagement member having elasticity and carried on the inner side of said front cover at such a position as to be snugly snapped on said retaining pin when said front cover is closed by said opening and closing means, wherein said opening and closing means includes a pair of cam forming lands formed on either side wall of said dispenser, and a pair of rollers mounted rotatably one on either side of said front cover to be moved while rolling on the cam surfaces of said lands.

2. A paper sheet storage box according to claim 1, wherein said auxiliary engagement member is a leaf spring having a generally U-shaped cross-section so as to be elastically warped and having its one end fixed to said front cover and its other free end bent slightly to form an angle, said retaining pin projecting at a right angle from said one side wall of said storage box.

3. A paper sheet storage box according to claim 2, wherein said retaining pin is a roller, whereby smooth engagement with said auxiliary engagement member is assured.

4. A paper sheet storage box according to claim 1, wherein said primary retaining means includes a retaining pawl carried on the inner side of said front cover, and a retaining mechanism mounted in said storage box and having its main retaining member biased to retain said retaining pawl.

5. A paper sheet storage box according to claim 4, wherein said retaining mechanism includes a preliminary retaining member, and an actuating member fixed on said dispenser for releasing said preliminary retaining member against the biasing force when said storage box is inserted into said dispenser.

* * * * *